US006796861B2

(12) United States Patent
Araki et al.

(10) Patent No.: US 6,796,861 B2
(45) Date of Patent: Sep. 28, 2004

(54) AIR-INTAKE SYSTEM OF ENGINE

(75) Inventors: Toshio Araki, Kakogawa (JP); Yoshinobu Tanaka, Hyogo (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/624,371

(22) Filed: Jul. 21, 2003

(65) Prior Publication Data

US 2004/0067701 A1 Apr. 8, 2004

(30) Foreign Application Priority Data

Jul. 22, 2002 (JP) ..... 2002-212068

(51) Int. Cl.[7] ..... B63H 21/10

(52) U.S. Cl. ..... 440/88 A

(58) Field of Search ..... 440/88 A, 88 R; 123/339.23

(56) References Cited

U.S. PATENT DOCUMENTS 6,520,147 B1 * 2/2003 Kanno ..... 123/339.23

* cited by examiner

*Primary Examiner*—Ed Swinehart
(74) *Attorney, Agent, or Firm*—Kolisch Hartwell, P.C.

(57) ABSTRACT

In an air-intake system of an engine of the present invention, a connecting pipe 50 having an inner diameter of approximately several mm is provided between an air-intake box 40 and an air-intake pipe 41. One opening end portion 50*a* of the connecting pipe 50 is connected to a bottom portion of the air-intake box 40 to open inside the air-intake box 40. A pipe 71 having an outer diameter substantially equal to an inner diameter of the connecting pipe 50, penetrates through an outer side of the curved portion of the air-intake pipe 41. The other opening end portion 50*b* of the connecting pipe 50 is connected to an end portion 71*a* of the pipe 71 that protrudes outside of the air-intake pipe 41. In this structure, oil reserved inside the air-intake box 40 is automatically delivered into a combustion chamber by an operation of the engine.

10 Claims, 7 Drawing Sheets

AIR-INTAKE SYSTEM OF ENGINE

BACKGROUND OF THE INVENTION

1. Field of the Invention

The present invention relates to an air-intake system of an engine, and more particularly to an air-intake system of an engine mounted in a small watercraft such as a personal watercraft (PWC).

2. Description of the Related Art

In general, an air-intake system of a four-cycle engine is configured to have an ambient-air inlet, an air cleaner for cleaning ambient air taken in from outside through the inlet, a throttle body for adjusting an air-intake amount, an air-intake box for temporarily storing the air (in the case of a multi-cylinder engine), and an air-intake pipe for leading the air into an air-intake port of the engine. In this air-intake system, these components are connected in this order.

Meanwhile, in a four-cycle engine, an internal pressure of a crankcase varies according to reciprocation of pistons or the like. Accordingly, in order to reduce an increased internal pressure of the crankcase, a breather pipe is provided between the crankcase and the air cleaner.

A blow-by gas flows from a combustion chamber of the engine into the crankcase through a clearance between a cylinder and a piston. The blow-by gas is delivered into the air cleaner through the breather pipe and mixed into the air inside the air cleaner. The blow-by gas mixed into the air is delivered from the air cleaner into the air-intake box, and further into the combustion chamber through the air-intake pipe connected to the air-intake box. The blow-by gas drawn into the combustion chamber is combusted with the air.

Typically, an oil pan is provided below the crankcase. Lubricating oil is reserved in the oil pan. The oil is sometimes changed into mist, which is mixed with the blow-by gas. In order to liquefy the oil mist mixed with the blow-by gas and return the oil into the oil pan, an oil separator is provided at a position in the breather pipe.

Such oil mist is delivered together with the blow-by gas into the air cleaner through the breather pipe and into the air-intake box. The oil mist delivered into the air-intake box is drawn into the combustion chamber of the engine together with the air and the blow-by gas through the air-intake pipe.

However, part of the oil mist delivered into the air-intake box is liquefied inside the air-intake box and is stored in a bottom portion thereof.

In order to remove the oil residing in the air-intake box in the four-cycle engine configured as described above, it is necessary to provide an oil discharge hole on the bottom portion of the air-intake box and discharge the oil residing in the air-intake box through the oil discharge hole on a regular basis.

However, such regular oil discharge is burdensome. In particular, in a small watercraft such as a personal watercraft, the oil discharge is difficult because of its limited inner space.

SUMMARY OF THE INVENTION

The present invention addresses the above described condition, and an object of the present invention is to provide an air-intake system of an engine which is capable of automatically delivering oil residing inside an air-intake box into a combustion chamber according to an operation of an engine.

According to the present invention, there is provided an air-intake system of an engine, comprising an air-intake port provided in a cylinder head; an air-intake box provided in an air-intake flow passage of the engine; an air-intake pipe forming part of the air-intake flow passage connecting the air-intake box to the air-intake port; and a connecting pipe provided between the air-intake box and the air-intake pipe to allow the air-intake box and the air-intake pipe to communicate with each other, wherein the connecting pipe is configured such that one opening end portion thereof is connected to a bottom portion of the air-intake box to open inside the air-intake box and the other end portion thereof is connected to the air-intake pipe to open inside of the air-intake pipe.

A pressure difference is generated between the one opening end portion and the other opening end portion of the connecting pipe due to the flow rate (speed) difference of air taken in into the engine. Specifically, since the flow rate of the taken-in air flowing inside the air-intake pipe is higher than that of the air flowing inside the air-intake box, an internal pressure of the air-intake pipe is lower than an internal pressure of the air-intake box during an operation of the engine. In the above-described air-intake system, because of the pressure difference between the opening end portions of the connecting pipe, oil separated from the taken-in air with a blow-by gas inside the air-intake box and reserved in the bottom portion thereof, is suctioned up from the one opening end portion of the connecting pipe and drawn into the air-intake pipe through the other opening end portion. The oil is drawn into the combustion chamber together with the air. Thereby, in the air-intake system provided with the air-intake box at a position in the airflow passage, it is not necessary to discharge the oil residing inside the air-intake box regularly.

Preferably, the engine has multiple cylinders, and a plurality of air-intake ports and air-intake pipes, the air-intake pipes are configured to connect the plurality of air-intake ports to the air-intake box, respectively, and at least two of the air-intake pipes are connected to the air-intake box through the connecting pipe to allow an inside of the air-intake pipes and an inside of the air-intake box to communicate with each other. In this system, the oil reserved in the bottom portion of the air-intake box is quickly suctioned up through the connecting pipes.

Preferably, the air-intake box is configured to have an inner bottom face thereof inclined such that a portion of the inner bottom face which is close to a position where the air-intake box is connected to the one opening end portion of the connecting pipe is lower. In this structure, the oil reserved in the bottom portion of the air-intake box is easily guided to the one opening end portion of the connecting pipe and larger amount of oil is suctioned up from the bottom portion of the air-intake box through the connecting pipe.

Preferably, the air-intake system further comprises a one-way valve provided in the branch portions of the connecting pipe, and the one-way valve is configured to permit flow of a fluid from the one opening end portion toward the other opening end portion inside the connecting pipe and not to permit flow of the fluid from the other opening end portion toward the one opening end portion inside the connecting pipe. In this structure, backflow of the oil suctioned up through the one-way valve is inhibited. Consequently, the suctioned oil can be reliably delivered into the air-intake pipe.

Preferably, a direction in which the other opening end portion of the connecting pipe opens substantially corresponds with an air flow direction in which taken-in air flows inside the air-intake pipe. In this structure, a static pressure of the other opening end portion of the connecting pipe becomes lowest and, correspondingly, the pressure difference between the one opening end portion and the other opening end portion of the connecting pipe becomes larger. By utilizing this pressure difference, the oil can be efficiently suctioned up through the connecting pipe.

Preferably, the air-intake pipe includes a curved portion for allowing the air flow direction inside the air-intake pipe to be curved, and the other opening end portion of the connecting pipe is connected to an outer side of the curved portion of the air-intake pipe.

In the case of a curved flow passage, a flow rate of a fluid flowing inside the flow passage is higher and a pressure of the fluid is lower on the outer side of the curved flow passage. In the above structure, the pressure difference between the one opening end portion and the other opening end portion of the connecting pipe becomes larger, which facilitates upward suction of the oil.

Preferably, the other opening end portion of the connecting pipe is connected to the air-intake pipe in the vicinity of the air-intake port. In this system, the oil drawn from the connecting pipe into the air-intake pipe can be delivered into the combustion chamber more reliably. In addition, it is possible to minimize contamination of an inner wall of the air-intake pipe by the oil adhering to the inner wall.

The above and further objects and features of the invention will more fully be apparent from the following detailed description with accompanying drawings.

DETAILED DESCRIPTION OF THE PREFERRED EMBODIMENTS

Figure 1:
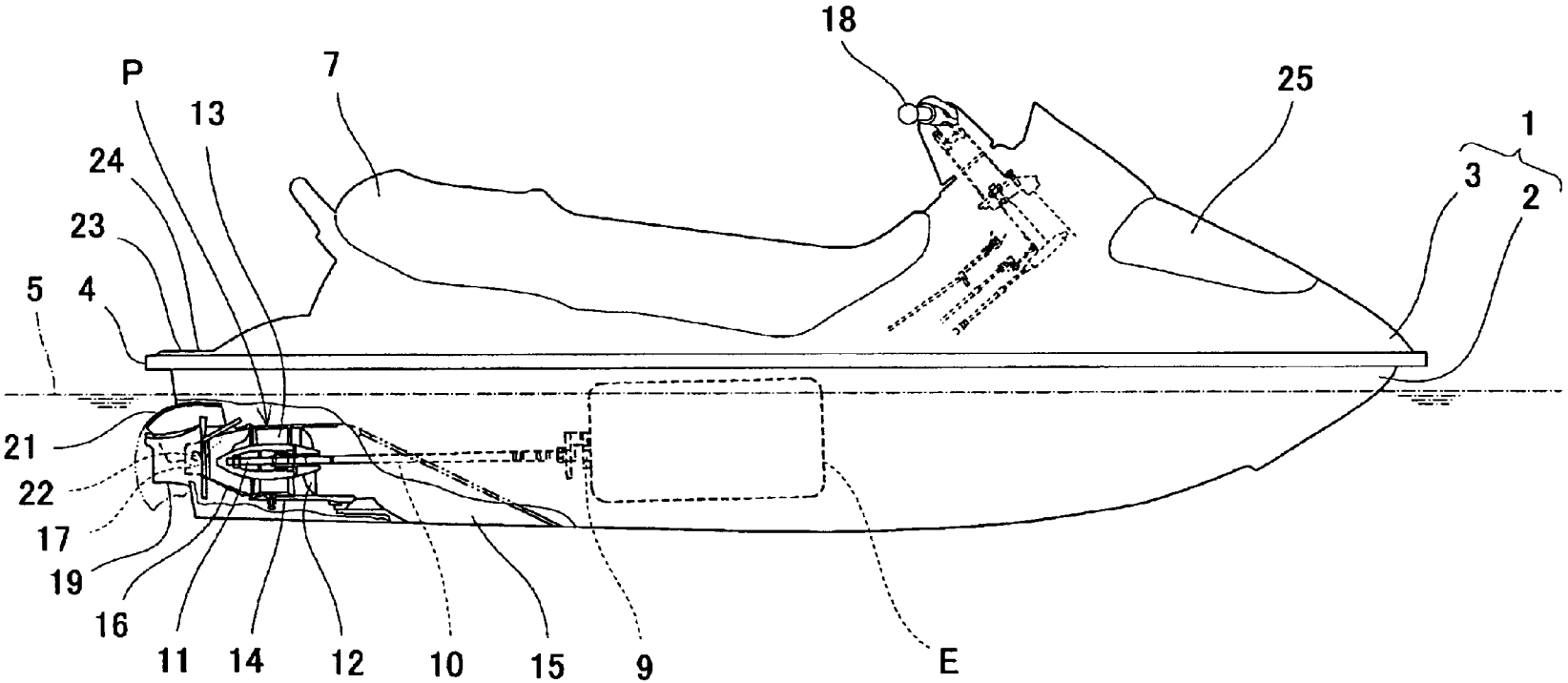
FIG. 1 is a side view of a personal watercraft in which an engine having an air-intake system according to an embodiment of the present invention is mounted.
Figure 2:
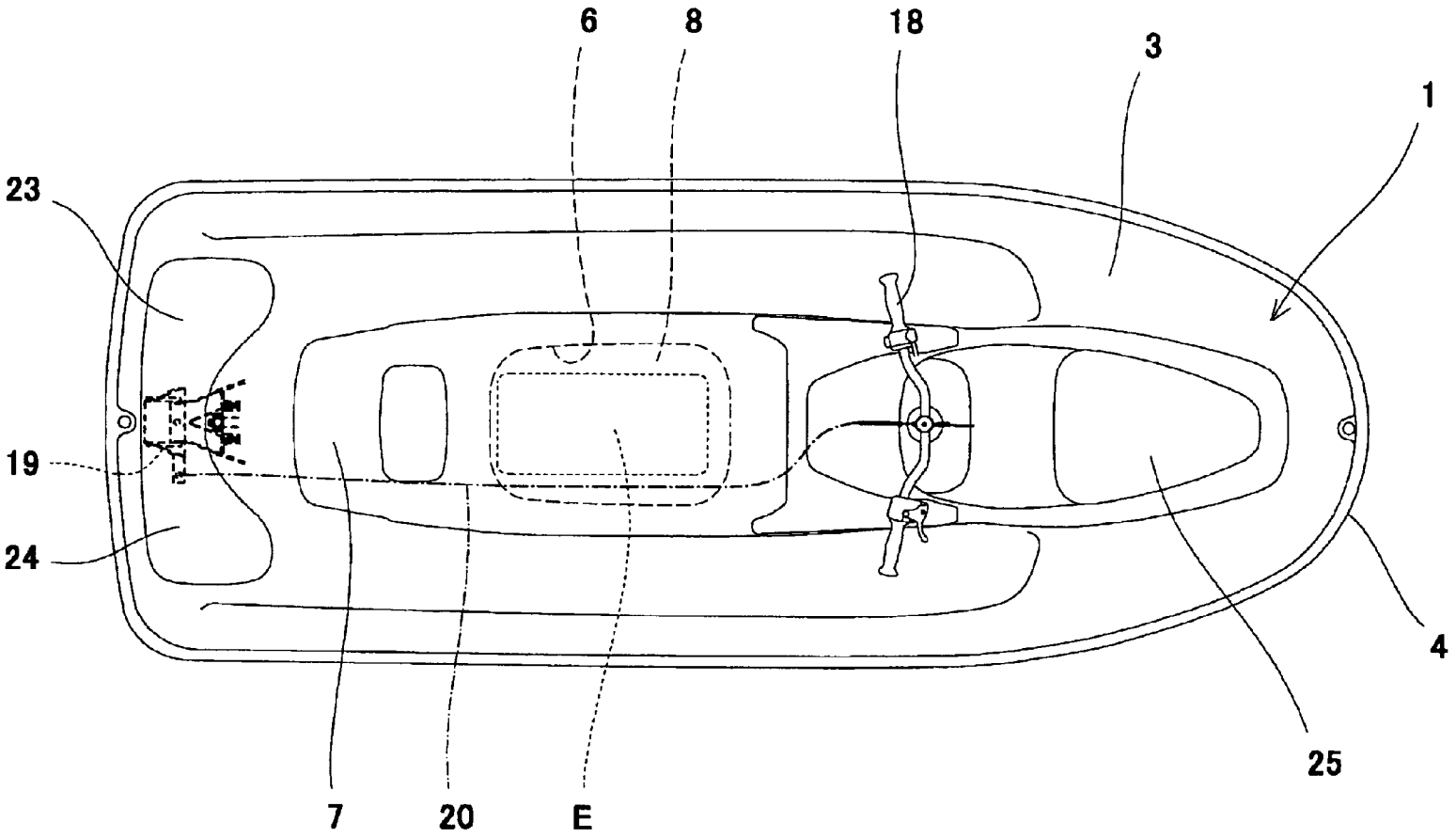
FIG. 2 is a plan view of the personal watercraft in FIG. 1.

Hereinafter, an embodiment of an air-intake system of an engine of the present invention will be described with reference to the accompanying drawings. FIG. 1 is a side view of a personal watercraft in which an engine having an air-intake system according to an embodiment of the present invention is mounted, and FIG. 2 is a plan view of the personal watercraft in FIG. 1. In the watercraft in FIG. 1, a body 1 of the watercraft comprises a hull 2 and a deck 3 covering the hull 2 from above. A line at which the hull 2 and the deck 3 are connected over the entire perimeter thereof is called a gunnel line 4. The gunnel line 4 is located above a waterline 5 of the watercraft.

As shown in FIG. 2, a deck opening 6, which has a substantially rectangular shape as seen from above is formed at a substantially center section of the deck 3 in the upper portion of the body 1 such that its longitudinal direction corresponds with the longitudinal direction of the body 1. A seat 7 is removably mounted over the deck opening 6.

An engine room 8 is provided in a space defined by the hull 2 and the deck 3 below the deck opening 6. An engine E is mounted in the engine room 8. In this embodiment, the engine E is an inline-type four-cylinder, four-cycle engine. As shown in FIG. 1, the engine E is mounted such that a crankshaft 9 of the engine E is placed along the longitudinal direction of the body 1.

An output end of the crankshaft 9 is rotatably coupled integrally with a pump shaft 11 of a water jet pump P provided on the rear side of the body 1 through a propeller shaft 10. An impeller 12 is attached on the pump shaft 11. Fairing vanes 13 are provided behind the impeller 12. The impeller 12 is covered with a pump casing 14 on the outer periphery thereof.

A water intake 15 is provided on the bottom of the body 1. The water intake 15 is connected to the pump casing 14 through a water passage. A pump nozzle 16 is provided on the rear side of the pump casing 14. The pump nozzle 16 has a cross-sectional area that is gradually reduced rearward, and an outlet port 17 is provided on the rear end of the pump nozzle 16.

The water outside the watercraft is sucked from the water intake 15 and fed to the water jet pump P. The water jet pump P pressurizes and accelerates the water and the fairing vanes 13 guide water flow behind the impeller 12. The water is ejected through the pump nozzle 16 and from the outlet port 17, and as the resulting reaction, the watercraft obtains a propulsion force.

In FIGS. 1 and 2, reference numeral 18 denotes a bar-type steering handle. The steering handle 18 is connected to a steering nozzle 19 provided behind the pump nozzle 16 through a cable 20 (see FIG. 2). When the rider rotates the handle 18 clockwise or counterclockwise, the steering nozzle 19 is swung toward the opposite direction so that the ejection direction of the water being ejected through the pump nozzle 16 can be changed, and the watercraft can be correspondingly turned to any desired direction while the water jet pump P is generating the propulsion force.

As shown in FIG. 1, a bowl-shaped reverse deflector 21 is provided on the rear side of the body 1 to have the steering nozzle 19 inside the deflector 21 such that it can vertically swing around a horizontally mounted swinging shaft 22. The deflector 21 is swung downward to a lower position around the swinging shaft 22 to deflect the ejected water from the steering nozzle 19 forward, and as the resulting reaction, the personal watercraft moves rearward.

In FIGS. 1 and 2, a rear deck 23 is provided in the rear section of the body 1. The rear deck 23 is provided with an openable rear hatch cover 24. A rear compartment (not shown) with a small capacity is provided under the rear hatch cover 24. In FIGS. 1 and 2, a front hatch cover 25 is provided in a front section of the body 1. A front compartment (not shown) is provided under the front hatch cover 25 for storing equipments and the like.

Figure 3:
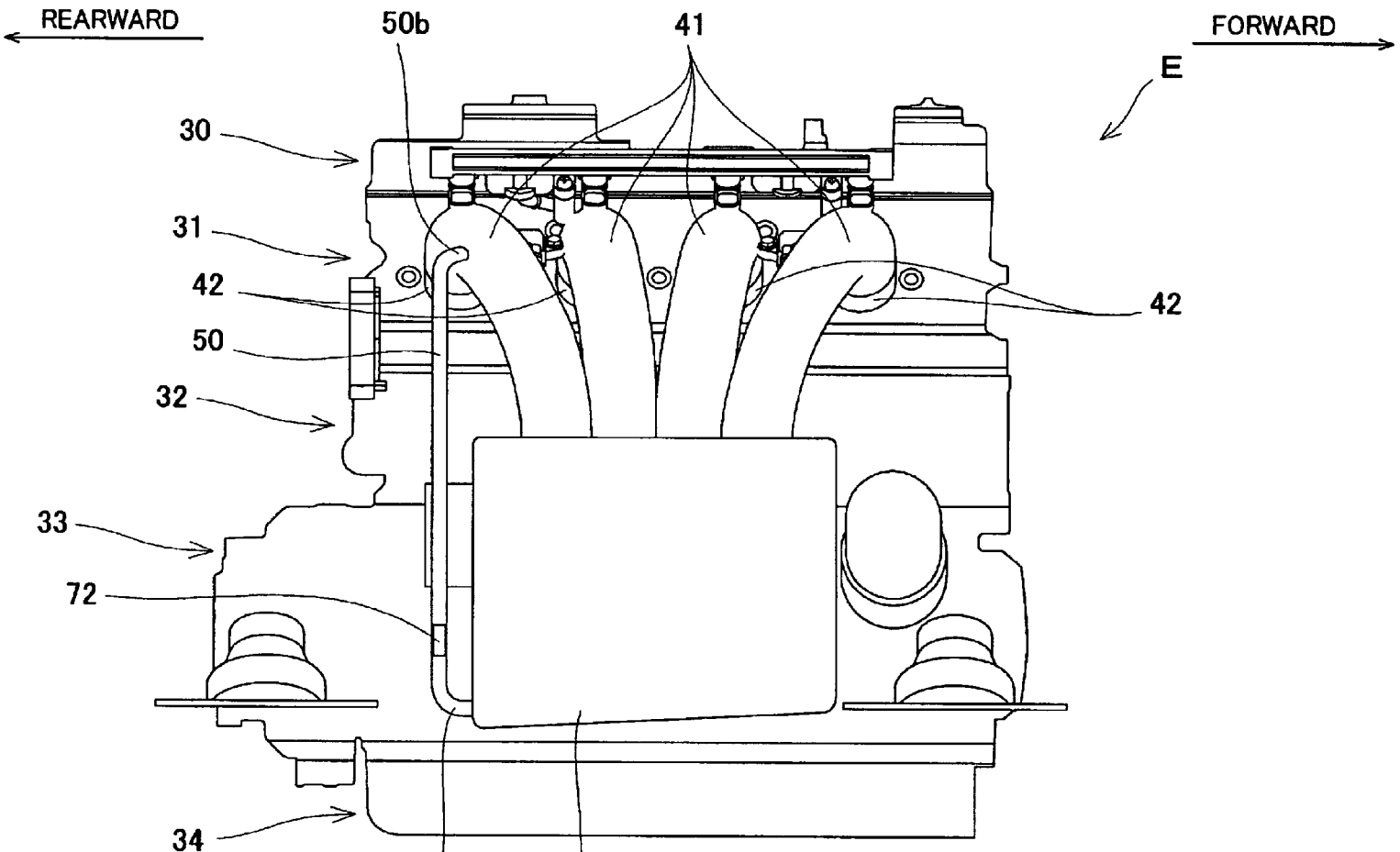
FIG. 3 is a right-side view of the engine having the air-intake system according to the embodiment.
Figure 4:
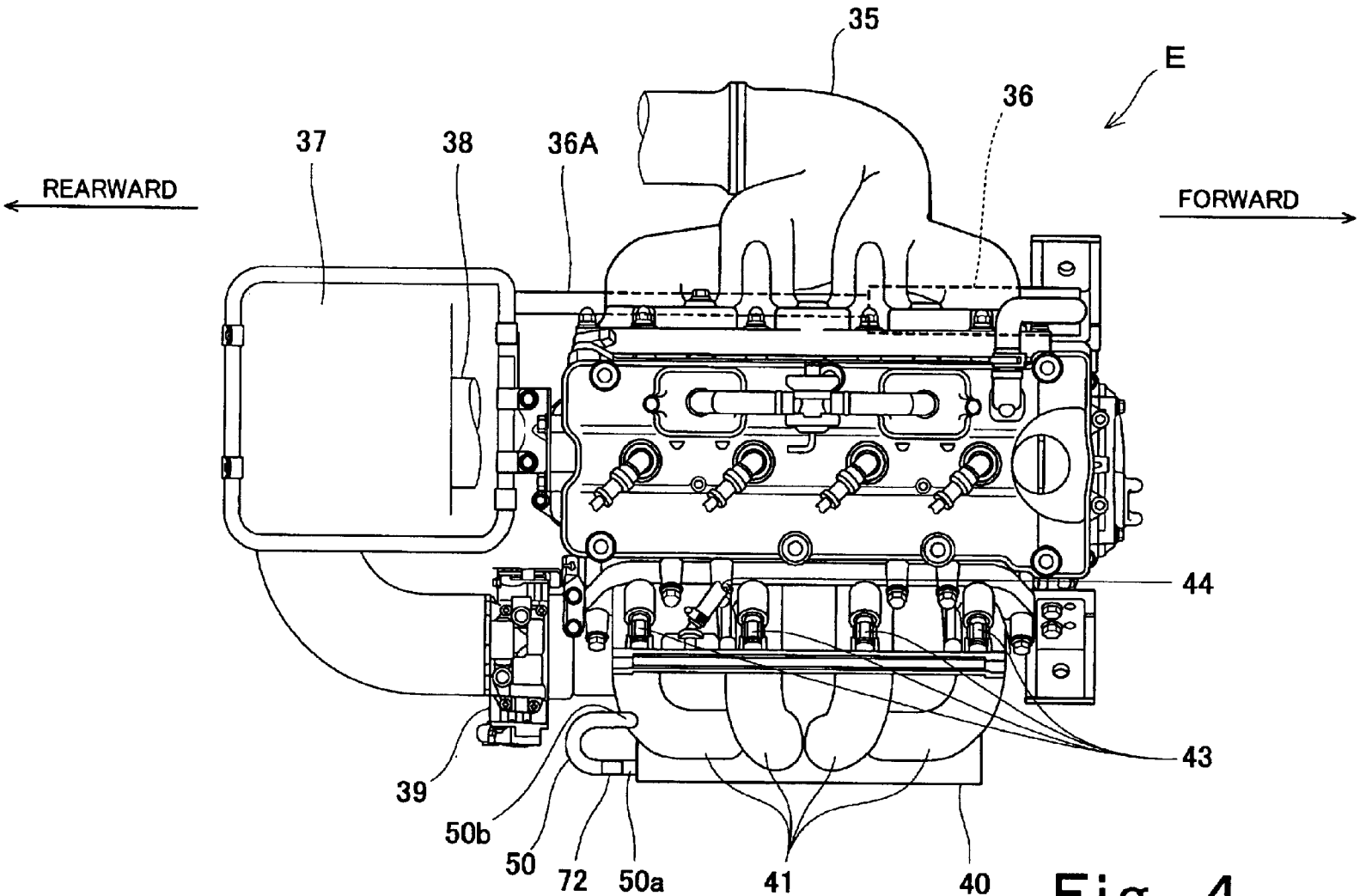
FIG. 4 is a plan view of the engine in FIG. 3.

Subsequently, a structure of the engine E relating to the air-intake system of the embodiment of the present invention will be described. FIG. 3 is a right-side view of the engine E having the air-intake system according to the embodiment. FIG. 4 is a plan view of the engine E in FIG. 3. The direction relating to the engine E corresponds with the direction (longitudinal, lateral, and vertical directions) relating to the personal watercraft with the engine E mounted in the personal watercraft in FIG. 1. As shown in FIG. 3, a body of the engine E mainly comprises a cylinder head 31 covered by a cylinder head cover 30 from above, a cylinder block 32 located under the cylinder head 31, a crankcase 33 located under the cylinder block 32, and an oil pan 34 located under the crankcase 33.

As described above, the engine E is an in-line four-cylinder engine. As shown in FIG. 4, on the left side of the engine E, an exhaust manifold 35 connected to exhaust ports (not shown) provided in the cylinder head 31 (see FIG. 3) is provided. Below the exhaust ports, an oil separator 36 is provided between the exhaust manifold 35 and the cylinder block 32 (see FIG. 3). An inner space of the crankcase 33 communicates with an inner space of a cam chamber (not shown) within the cylinder head 31 through the oil separator 36 and the oil separator 36 communicates with an air cleaner 37 placed behind the engine E through a breather pipe 36A.

The air cleaner 37 has an ambient-air inlet 38 and a filter (not shown) built therein and serves to clean the air taken into the engine through the ambient-air inlet 38. The air cleaner 37 communicates with an air-intake box 40 provided on the right side of the engine E through a throttle body 39.

One opening end portion of each of the four air-intake pipes 41 is connected to an upper portion of the air-intake box 40 as shown in FIGS. 3 and 4, while the other end portions of the air-intake pipes 41 are connected to air-intake ports 42 provided on the right side of the cylinder head 31, as shown in FIG. 3. In other words, the air-intake pipes 41 form air-intake flow passages connecting the air-intake box 40 to the air-intake ports 42.

The air-intake box 40 serves to temporarily store the taken-in air delivered from the air cleaner 37 in an inner space having a certain volume to allow a dynamic pressure of the taken-in air to be reduced and then supply the resulting air from the inner space to the air-intake pipes 41, thereby allowing the taken-in air to flow smoothly inside the air-intake pipes 41. In brief, in the engine E, the air-intake box 40 is provided in an air-intake flow passage of the engine E to have a large inner space to allow air to be distributed properly to the cylinders.

The air-intake pipes 41 are respectively provided with fuel injection valves 43 in the vicinity of the position where the air-intake pipes 41 are connected to the air-intake ports 42 of the cylinder head 31 to allow a fuel to be injected into the air-intake pipes 41. A fuel feed pipe 44 is connected to the fuel injection valves 43 so that the fuel is fed into the fuel injection valves 43 through the fuel feed pipe 44.

A connecting pipe 50 having a small inner diameter (several mm) is provided between the air-intake box 40 and the air-intake pipe 50 to allow the air-intake box 40 and the air-intake pipes 41 to communicate with each other. The connecting pipe 50 has one opening end portion 50*a* and the other opening end portion 50*b*. The opening end portion 50*a* of the connecting pipe 50 is connected to a bottom portion of the air-intake box 40.

Figure 5A:
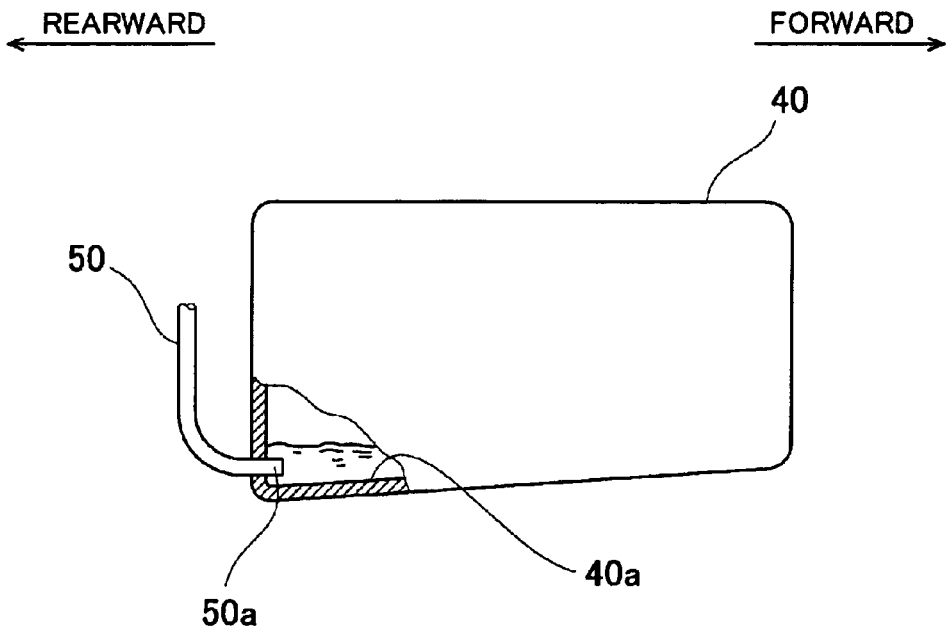
FIG. 5A is a schematic view showing a configuration in which a connecting pipe is connected to an air-intake box as seen from a right side of the engine.

FIG. 5A is a schematic view showing a configuration in which the connecting pipe 50 is connected to the air-intake box 40 as seen from the right side of the engine E. The air-intake box 40 has an inner bottom face 40*a* slightly inclined such that its rear portion is lower than its front portion. The opening end portion 50*a* of the connecting pipe 50 is connected to a side face of the bottom portion of the air-intake box 40 from behind to open forwardly inside the air-intake box 40.

Figure 5B:
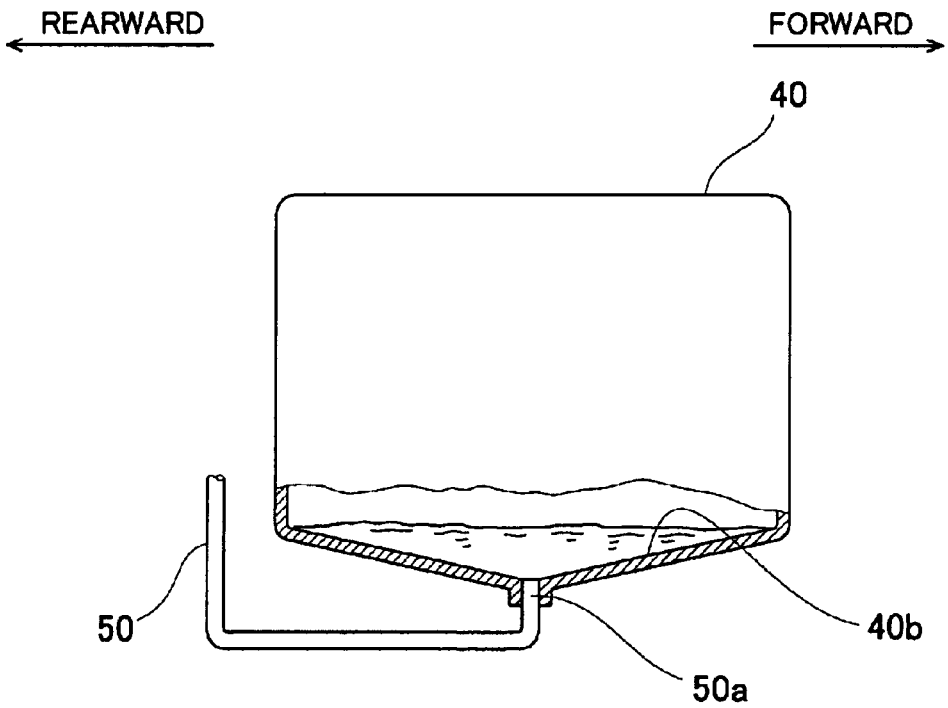
FIG. 5B is a schematic view showing another configuration in which the connecting pipe is connected to the air-intake box as seen from the right side of the engine.

FIG. 5B is a schematic view showing another configuration in which the connecting pipe 50 is connected to the air-intake box 40. In the configuration in FIG. 5B, an inner bottom face 40*b* of the air-intake box 40 is inclined such that a substantially center portion in the longitudinal direction is lower than its front portion and its rear portion. The opening end portion 50*a* of the connecting pipe 50 is connected to the substantially center portion of the bottom portion of the air-intake box 40 from below to open upwardly inside the air-intake box 40.

The configuration in which the connecting pipe 50 is connected to the air-intake box 40 and the structure of the inner bottom portion 40*a* or 40*b* of the air-intake box 40 are not intended to be limited to those in FIGS. 5A and 5B, but other configuration and structure may be used provided that oil residing inside the bottom portion of the air-intake box 40 is easily guided into the opening end portion 50*a* of the connecting pipe 50 connected to the bottom portion of the air-intake box 40.

Figure 6:
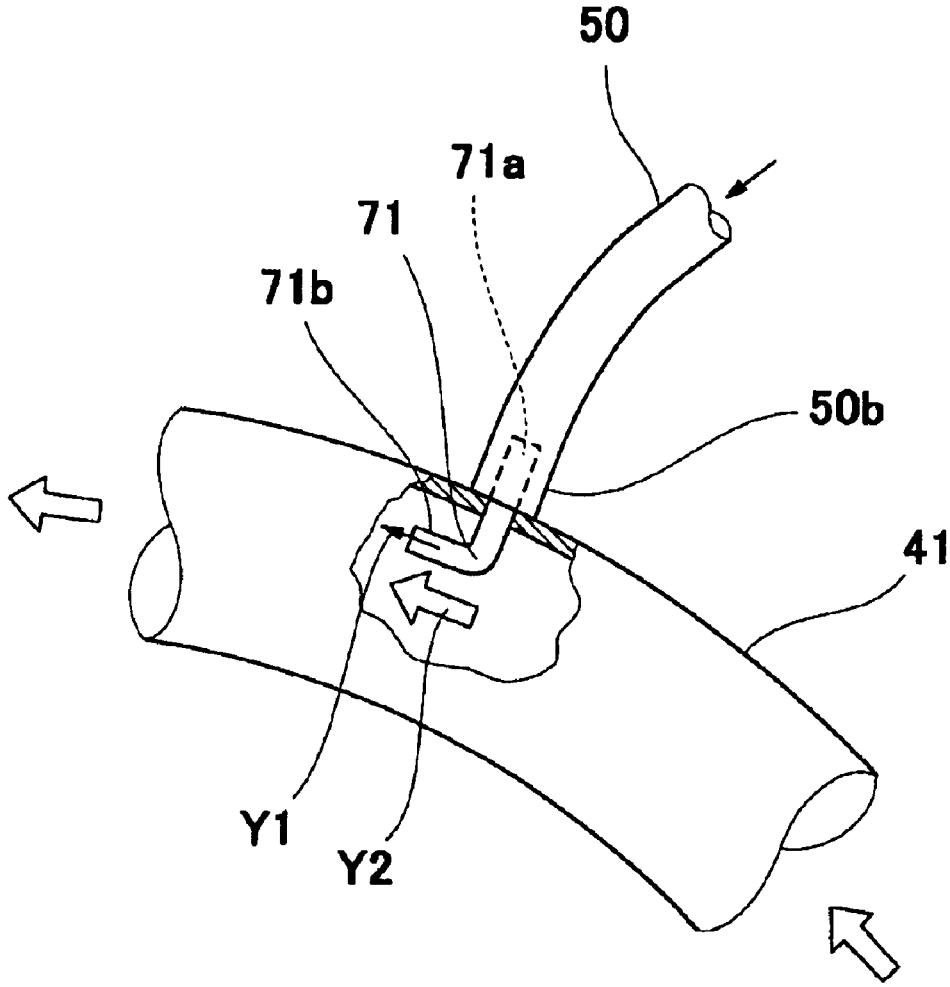
FIG. 6 is a schematic view showing a configuration in which the connecting pipe is connected to an air-intake pipe.

FIG. 6 is a schematic view showing a configuration in which the connecting pipe 50 is connected to the air-intake pipe 41. As shown in FIG. 6, a pipe 71 penetrates through a wall portion on an outer side of a curved portion of the air-intake pipe 41. The pipe 71 has an outer diameter substantially equal to an inner diameter of the connecting pipe 50 and defines a direction in which the opening end portion 50*b* of the connecting pipe 50 opens. The pipe 71 has one end portion 71*a* and the other end portion 71*b*. The opening end portion 50*b* of the connecting pipe 50 is connected to the end portion 71*a* of the pipe 71. The direction Y in which the end portion 71*b* of the pipe 71 opens substantially corresponds with the direction Y2 in which the taken-in air flows inside the air-intake pipe 41. That is, the end portion 71*b* of the pipe 71 opens toward downstream side in the air flow passage so that a fluid flowing inside the pipe 71 is affected less by a dynamic pressure generated by the air flowing inside the air-intake pipe 41.

As shown in FIGS. 3 and 4, a one-way valve 72 is provided in the vicinity of the opening end portion 50*a* of the connecting pipe 50 (opening end portion on the air-intake box 40 side). As the one-way valve 72, for example, a valve provided with a spring and a bulb within a cylindrical housing, which is a known valve, may be used. The one-way valve 72 is configured to permit flow of fluid from the opening end portion 50*a* of the connecting pipe 50 toward the opening end portion 50*b* of the connecting pipe 50 and not to permit flow of the fluid from the opening end portion 50*b* toward the opening end portion 50*a*.

In the air-intake system of the engine E having such a structure, a blow-by gas with oil mist flow from the crankcase 33 into the oil separator 36 on the left side of the engine E. The oil mist in the blow-by gas flowing into the oil separator 36 partially remains unliquefied and unseparated from the blow-by gas, and such blow-by gas with oil mist are delivered into the air cleaner box 37 through a breather pipe 36A. Inside the air cleaner box 37, the blow-by gas with oil mist are mixed with the air taken in from outside.

The taken-in air containing the blow-by gas with the oil mist is delivered into the air-intake box 40 based on the degree to which a throttle in the throttle body 39 is open. The oil mist contained in the taken-in air delivered into the air-intake box 40 is liquefied and separated from the taken-in air inside the air-intake box 40. The separated oil is reserved in the bottom portion of the air-intake box 40. The oil mist remaining unseparated from the taken-in air are drawn from the air-intake ports 42 into the combustion chamber of the engine E through the air-intake pipes 41, and are combusted therein.

In general, a static pressure of a fluid flowing inside a pipe decreases with an increase in flow rate of the fluid. The flow rate of the fluid increases with a decrease in flow cross-sectional area under a constant flow amount. While the taken-in air is drawn into the cylinder, flow rate of the taken-in air flowing inside the air-intake pipe 41 is higher than that of the air-intake box 40, because an airflow cross-sectional area of the air-intake pipe 41 is smaller than that of the air-intake box 40. Therefore, a static pressure of the taken-in air inside the air-intake pipe 41 is lower than that in the air-intake box 40.

As described above, the opening end portion 50*b* of the connecting pipe 50 is connected to the outer side of the curved portion of the air-intake pipe 41, where the flow rate is higher than that of the inner side of the curved portion of the air-intake pipe 41. Further, as described above, the direction Y1 in which the end portion 71*b* of the pipe 71 opens substantially corresponds with the direction Y2 in which the taken-in air flows inside the air-intake pipe 41. Therefore, the static pressure in the vicinity of the end portion 71*b* of the pipe 71 is lower than that inside the air-intake box 40.

As should be appreciated, due to a pressure difference between the opening end portions 50*a* and 50*b* of the connecting pipe 50, the liquefied oil reserved in the bottom of the air-intake box 40 is drawn up from the opening end portion 50*a* into the opening end portion 50*b* of the connecting pipe 50. That is, the oil is drawn up from the air-intake box 40 into the air-intake pipe 41 through the connecting pipe 50. The one-way valve 72 provided in the connecting pipe 50, inhibits the oil drawn up into the connecting pipe 50 through the one-way valve 72 from flowing back into the air-intake box 40.

The oil drawn up into the connecting pipe 50 flows through the opening end portion 50*b* of the connecting pipe 50 and is led into the air-intake pipe 41 in the vicinity of the air-intake port 42. The oil is drawn into the combustion chamber, together with the taken-in air flowing inside the air-intake pipe 41 and the fuel being fed from the fuel injection valve 43, and the mixture is combusted therein.

In the air-intake system of the engine E configured as described above, the oil reserved inside the air-intake box 40 is drawn up through the connecting pipe 50 according to an operation of the engine E and is combusted. In this system, it is not necessary to provide an oil discharge hole in the bottom portion of the air-intake box 40 and discharge the oil reserved inside the air-intake box 40 through the oil discharge hole on a regular basis.

In this embodiment, the connecting pipe 50 is provided between the air-intake box 40 and the air-intake pipe 41. Alternatively, the connecting pipe 50 may be provided between each of a plurality of air-intake pipes 41 and the air-intake box 40.

Figure 7:
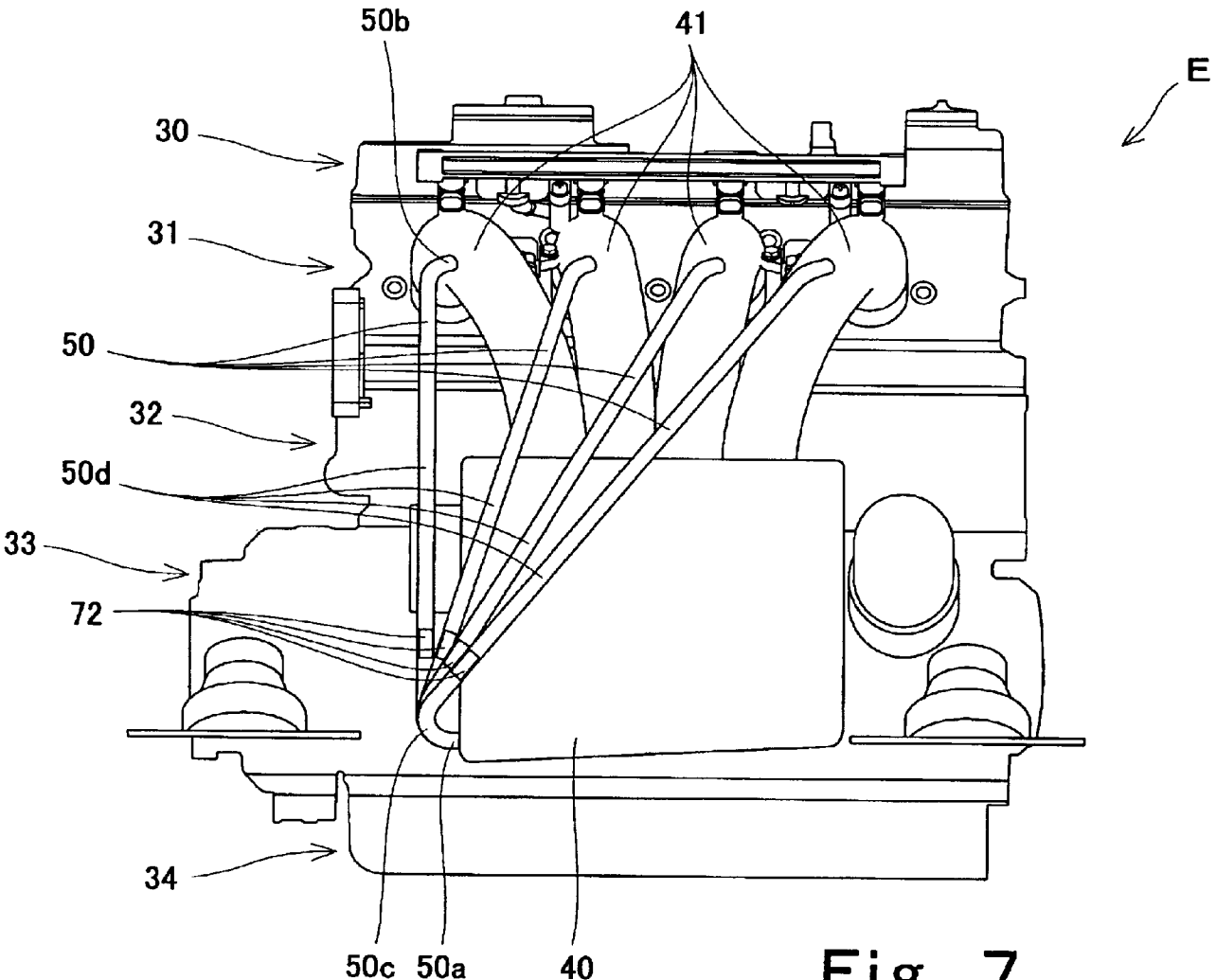
FIG. 7 is a right-side view of an engine provided with a connecting pipe having another configuration.

As shown in FIG. 7, the connecting pipe 50 has a base portion 50C having the opening end portion (one opening end portion) 50*a* of the connecting pipe 50 to be connected to the bottom portion of the air-intake box 40 and has a plurality of branch portions 50*d* branching from the base portion 50C. The branch portions 50*d* have the opening end portions (the other opening end portions) 50*b* connected to the air-intake pipes 41, respectively. In this structure, it is desirable to provide the one-way valve 72 in each of the branch portions 50*d* of the connecting pipes 50.

In the air-intake system configured as described above, the oil inside the air-intake box 40 can be quickly delivered into the combustion chamber by drawing the oil into the air-intake pipes 41 through the plurality of connecting pipes 50.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An air-intake system of an engine, comprising:

an air-intake port provided in a cylinder head;

an air-intake box provided in an air-intake flow passage of the engine;

an air-intake pipe forming part of the air-intake flow passage connecting the air-intake box to the air-intake port; and a connecting pipe provided between the air-intake box and the air-intake pipe to allow the air-intake box and the air-intake pipe to communicate with each other, wherein the connecting pipe is configured such that one opening end portion thereof is connected to a bottom portion of the air-intake box to open inside the air-intake box and the other end portion thereof is connected to the air-intake pipe to open inside of the air-intake pipe.

2. The air-intake system of an engine according to claim 1, wherein the air-intake box is configured to have an inner bottom face thereof inclined such that a portion of the inner bottom face which is close to a position where the air-intake box is connected to the one opening end portion of the connecting pipe is lower.

3. The air-intake system of an engine according to claim 1, further comprising:

a one-way valve provided in the connecting pipe, wherein the one-way valve is configured to permit flow of a fluid from the one opening end portion toward the other opening end portion inside the connecting pipe and not to permit flow of the fluid from the other opening end portion toward the one opening end portion inside the connecting pipe.

4. The air-intake system of an engine according to claim 1, wherein a direction in which the other opening end portion of the connecting pipe opens substantially corresponds with an air flow direction in which taken-in air flows inside the air-intake pipe.

5. The air-intake system of an engine according to claim 4, wherein the air-intake pipe includes a curved portion for allowing the air flow direction inside the air-intake pipe to be curved, and wherein the other opening end portion of the connecting pipe is connected to an outer side of the curved portion of the air-intake pipe.

6. The air-intake system of an engine according to claim 4, wherein the other opening end portion of the connecting pipe is connected to the air-intake pipe in the vicinity of the air-intake port.

7. The air-intake system of an engine according to claim 1, wherein the engine has multiple cylinders, and a plurality of air-intake ports and air-intake pipes, the air-intake pipes are configured to connect the plurality of air-intake ports to the air-intake box, respectively, and at least two of the air-intake pipes are connected to the air-intake box through the connecting pipe to allow an inside of the air-intake pipes and an inside of the air-intake box to communicate with each other.

8. The air-intake system of an engine according to claim 7, wherein the connecting pipe includes a base portion having the one end portion to be connected to the air-intake box, and branch portions having the other opening end portions to be connected to the air-intake pipes, respectively.

9. The air-intake system of an engine according to claim 8, further comprising:

one-way valves respectively provided in the branch portions of the connecting pipe, wherein the one-way valves are each configured to permit flow of a fluid from the one opening end portion toward the other opening end portion inside the connecting pipe and not to permit flow of the fluid from the other opening end portion toward the one opening end portion inside the connecting pipe.

10. The air-intake system of an engine according to claim 1, further comprising:

a breather pipe communicating with a crankcase of the engine; and an air cleaner located upstream of the air-intake box in the air flow passage, wherein the breather pipe communicates with the air cleaner.

* * * * *